United States Patent [19]

LaSota

[11] Patent Number: 4,777,925

[45] Date of Patent: Oct. 18, 1988

[54] COMBINED FUEL INJECTION-SPARK IGNITION APPARATUS

[76] Inventor: Lawrence LaSota, 15745 N. Park,, E. Detroit, Mich. 48021

[21] Appl. No.: 158,838

[22] Filed: Feb. 22, 1988

[51] Int. Cl.[4] ..... F02P 3/02

[52] U.S. Cl. ..... 123/635; 123/612; 123/652

[58] Field of Search ..... 123/149 R, 149 A, 152, 123/475, 612, 617, 634, 635, 642, 651, 652

[56] References Cited

U.S. PATENT DOCUMENTS

| | | | |
|---|---|---|---|
| 3,368,788 | 2/1968 | Padula . | |
| 3,892,207 | 7/1975 | Weise et al. | 123/475 X |
| 4,066,059 | 1/1978 | Mayer et al. . | |
| 4,111,178 | 9/1978 | Casey . | |
| 4,172,439 | 10/1979 | Pasbrig . | |
| 4,295,453 | 10/1981 | Seilly et al. . | |
| 4,342,443 | 8/1982 | Wakeman . | |
| 4,522,372 | 6/1985 | Yano et al. . | |
| 4,546,955 | 10/1985 | Beyer et al. . | |
| 4,573,659 | 3/1986 | Homes . | |
| 4,676,478 | 6/1987 | Kiuchi . | |

FOREIGN PATENT DOCUMENTS

| | | | |
|---|---|---|---|
| 2051230 | 1/1981 | United Kingdom | 123/612 |

*Primary Examiner*—Tony M. Argenbright

*Attorney, Agent, or Firm*—Basile and Hanlon

[57] ABSTRACT

An electromagnetic coil operates a fuel injector valve and generates a high voltage pulse to ignite a spark plug in an internal combustion engine. The primary and secondary windings of a coil are disposed between inner and outer cores. Electric current flowing at a first level through the primary winding induces magnetic flux in a first flux path to move a fuel flow control member to open a fuel flow path between a fuel inlet and a fuel outlet in the fuel injector valve. Current flowing at a second higher level through the primary winding induces a higher level of magnetic flux in a second flux path to move the fuel flow control member to a position closing the fuel flow path. A controller generates the first and second primary winding currents at the proper time in the engine operating cycle in response to engine operating conditions. Cessation of current flow in the primary winding collapses the magnetic field in the inner and outer cores causing a high voltage to be generated in the secondary winding to ignite the spark ignition device in the engine.

10 Claims, 3 Drawing Sheets

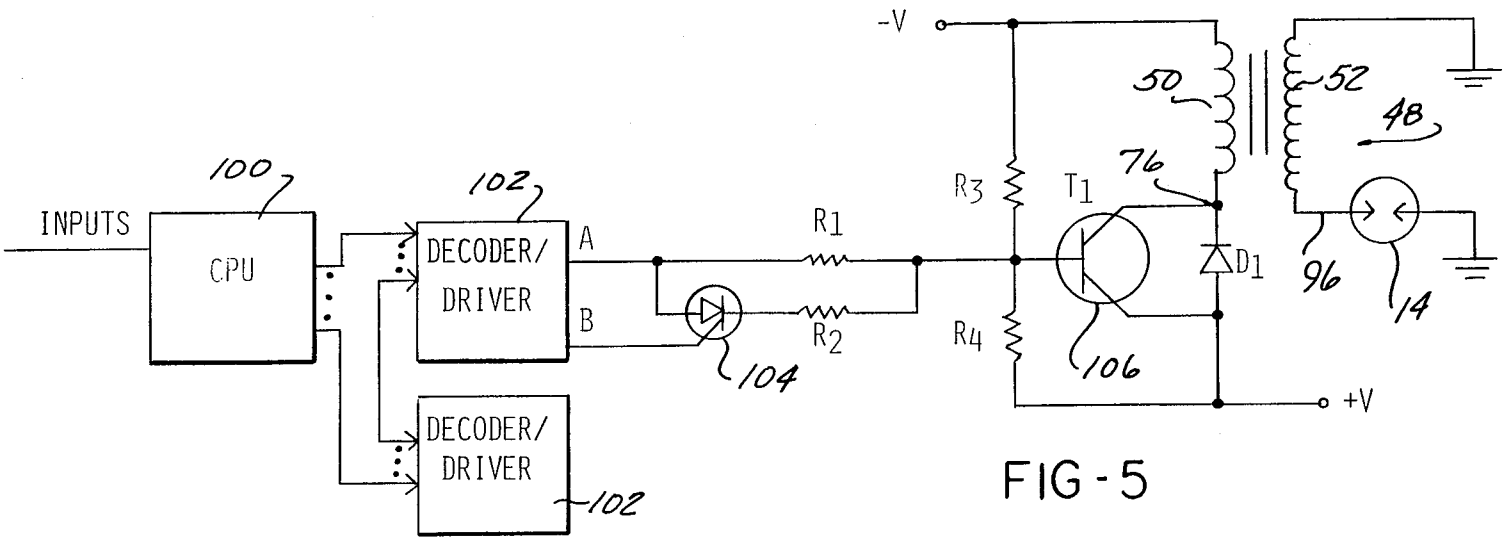
FIG-5
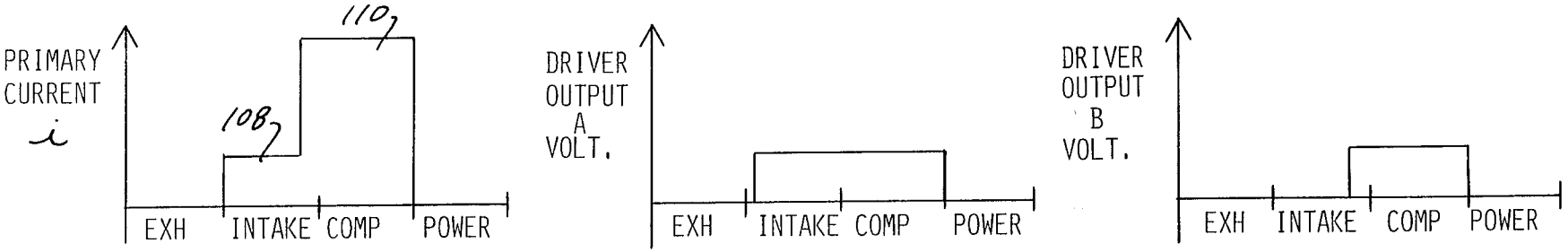
FIG-6A
FIG-6B
FIG-6C

COMBINED FUEL INJECTION-SPARK IGNITION APPARATUS

BACKGROUND OF THE INVENTION

1. Field of the Invention:

The present invention relates, in general, to fuel injection/spark ignited internal combustion engines and, more specifically, to fuel injection valves for fuel injected/spark ignited internal combustion engines.

2. Description of the Prior Art:

Fuel injection systems for internal combustion engines utilize a fuel injection valve associated with each cylinder for controlling the metering of fuel into each cylinder of the engine. The valve typically is formed of an electromagnetic coil wound about a magnetic core or stator and a spaced, movable armature core attached to a needle valve for opening and closing an injection port in the valve body. An electric current applied to the coil causes the armature to be attracted toward the stator thereby moving the needle valve to open the fuel injection port.

Such engines also employ a separate coil to provide the high voltage spark necessary to ignite the fuel in each cylinder. Such arrangements include a single coil mounted in a distributor which applies a high voltage to the individual spark plugs through contacts or points mounted in the distributor. Also, fuel ignition is achieved in a so-called "direct fire" ignition system by means of a separate coil associated with each spark plug of the engine.

Timing controls are required for energizing the fuel injection valve and igniting the spark plug of each cylinder of the engine at proper times in the engine operating cycle. In a conventional engine timing system, electronic circuits responsive to the angular rotational position of the engine crank shaft energize the coil in the fuel injection valve to control the amount of fuel metered through the valve into a particular cylinder of the engine and then energize the spark ignition coil to supply the high voltage pulse to the spark plug in the cylinder to ignite the fuel. However, the use of separate coils for the fuel injection valve and the spark ignition circuit results in a complex, space consuming system which includes numerous inherent timing problems due to the use of a large number of components.

Attempts have also been made to overcome timing problems inherent with the use of crank shaft angle based timing systems by developing valves which supply an electric spark initiate signal to the spark coil at the appropriate time in response to the buildup of fluid pressure in the fuel injection system. This eliminates the need for separate timing controls for the fuel injector valve and the spark plug; but still utilizes separate coils for the high voltage spark and the activation of the fuel injector valve.

Thus, it would be desirable to provide an improved fuel injection/spark ignition apparatus which overcomes the problems encountered with previous fuel injection/spark ignition systems. It would also be desirable to provide a fuel injection/spark ignition apparatus which uses a minimal number of components to control the metering of fuel and spark ignition. It would also be desirable to provide an improved fuel injection/spark ignition apparatus which simplifies the timing requirements for controlling both fuel injection and spark ignition.

SUMMARY OF THE INVENTION

The present invention is a combined fuel injection/-spark ignition apparatus which utilizes a single electromagnetic coil to operate a fuel injector valve and to generate a high voltage to ignite a spark plug for a particular cylinder in an internal combustion engine.

The apparatus includes a valve body having a fuel inlet, a fuel outlet and a fuel flow path extending therebetween. Fuel flow control means are provided for controlling the flow of fuel between the fuel inlet and the fuel outlet. The apparatus also includes spaced, inner and outer magnetic cores. Coil means including primary and secondary windings surround the inner core for inducing magnetic flux in the inner and outer cores. The secondary windings are connectible to the engine spark igniting means, such as a spark plug in each cylinder of the engine. Means are provided for applying electric current at first and second different levels to the primary windings of the coil at predetermined time intervals during a single engine operating cycle.

The apparatus further includes a first magnetic flux means through which magnetic flux passes when an electric current of a first level is applied to the primary winding for moving the fuel flow control means from a first position closing the fuel flow path to a second position opening the fuel flow path for the flow of fuel between the fuel inlet and the fuel outlet. A second magnetic flux means is provided through which magnetic flux passes when a current of a second higher level is applied to the primary winding for shunting magnetic flux from the first magnetic flux means and moving the fuel flow control means to the first position closing the fuel flow path.

In a preferred embodiment, the first magnetic flux means comprises one end portion of the outer core means being spaced from and disposed in proximity with one end portion of the inner core. The fuel flow control means includes a first plunger movable between a first position closing the fuel outlet and a second position spaced from the fuel outlet thereby allowing fuel flow through the fuel flow path from the fuel inlet to the fuel outlet. A first biasing means is provided for normally biasing the first plunger to the first position closing the fuel flow path.

Current at the first level passing through the primary winding of the coil induces magnetic flux in the inner and outer core means which attracts the first plunger toward the end portions of the inner and outer cores overcoming the reluctance of the air gap between the ends of the cores and the first plunger and the bias of the first biasing means thereby bringing the first plunger into contact with the end portions of the inner and outer cores completing the magnetic circuit between the inner and outer cores.

In a preferred embodiment, the second magnetic flux means comprises the outer core having an intermediate core portion which is spaced from an intermediate portion of the inner core. A second magnetic plunger is slidably disposed for movement from a first position spaced from the intermediate portions of the inner and outer cores and a second position contacting the spaced intermediate portions of the inner and outer cores to form a shunt path which shunts magnetic flux away from the end portions of the inner and outer cores when a current at the second higher level is applied to the primary winding of the coil. The higher current generates a higher level of magnetic flux which overcomes the bias of the second biasing means associated with the second plunger which has a higher biasing force than the force provided by the first biasing means associated with the first plunger.

When the magnetic shunt path is formed by movement of the second plunger to the second position, magnetic flux ceases to flow through the end portions of the inner and outer cores thereby collapsing the magnetic field in the end portions of the inner and outer cores and causing the first plunger to move under the bias of the first biasing means to the first position closing the fuel outlet and stopping the flow of fuel through the fuel outlet.

The application of the first and second currents to the primary winding is provided by a control means, such as a microprocessor, which executes a stored control program. The microprocessor is responsive to inputs corresponding to engine operating conditions, such as crank shaft angle, engine temperature, fuel/air mixture, engine speed, etc. At the proper engine operating cycle position associated with a particular cylinder, the microprocessor generates an output signal which, through an output means, such as a power transistor, causes a current at a first magnitude or level to flow through the primary winding of the coil. At a subsequent time when fuel input is to be stopped, the microprocessor generates a signal causing a second higher level of current to pass through the primary winding of the coil. Cessation of current flow through the primary winding under the control of the microprocessor causes a collapse of the magnetic field in the inner and outer cores and generates a high voltage in the secondary winding of the coil which is passed through leads connecting the secondary winding of the coil to the associated spark plug and provides the potential to ignite the spark plug causing combustion of the fuel which has been injected into one cylinder of the engine.

The combined fuel injection/spark ignition apparatus of the present invention provides many advantages over previously devised fuel injection/spark ignition systems in that it employs a single coil to control both the fuel injector valve and the ignition of the associated spark plug for a particular cylinder of an engine. This is achieved by uniquely providing current at two different levels to the coil which due to the unique structure of the inner and outer cores of the fuel injector valve causing selected movement of the fuel flow control means to open and close the flow of fuel through the fuel outlet in the valve body. The use of a single coil to control the operation of the fuel injector valve and to provide spark ignition uniquely provides a simple and expedient means for performing both functions in a single unit thereby minimizing the number of individual components and space requirements in an engine.

BRIEF DESCRIPTION OF THE DRAWING

The various features, advantages and other uses of the present invention will become more apparent by referring to the following detailed description and drawing in which:

FIG. 5 is a circuit diagram of the control timing and current generating means employed in the combined fuel injection/spark ignition apparatus of the present invention; and FIGS. 6A, 6B and 6C are wave forms depicting the primary winding current, driver output A voltage and driver output B voltage magnitudes during various stages of an engine operating cycle.

DESCRIPTION OF THE PREFERRED EMBODIMENTS

Figure 1:
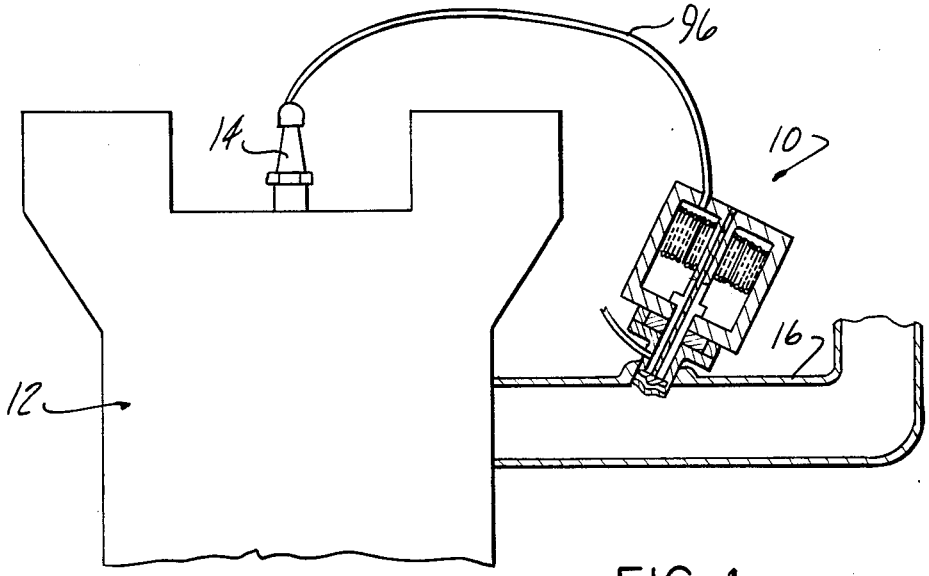
FIG. 1 is a pictorial, partially cross sectioned view of an internal combustion engine having a combined fuel injection/spark ignition apparatus of the present invention mounted thereon.

Throughout the following description and drawing, an identical reference number is used to refer to the same component shown in multiple figures of the drawing.

Referring now to the drawing, and to FIG. 1 in particular, there is illustrated a combined fuel injection/-spark ignition apparatus 10 for use on fuel injectedspark ignited internal combustion engines 12. The combined fuel injection/spark ignition apparatus 10 controls the amount of fuel metered into a particular combustion chamber or cylinder of the engine 12 and also provides a high voltage at the proper time in the engine operating cycle to ignite the spark plug, thus, to ignite the fuel in the combustion chamber.

The engine 12 may be any type of internal combustion engine which includes a plurality of individual combustion chambers, such as four, six, eight, etc., into which fuel is injected and burned through igniting a spark ignition means, such as a conventional spark plug 14 extending into each combustion chamber. By way of example only, the engine 12 is shown with a single combined fuel injection/spark ignition apparatus 10 and associated spark plug 14. It will be understood that identical fuel injection/spark ignition apparatuses are provided for each spark plug and combustion chamber of the engine 12.

Further, the combined fuel injection/spark ignition apparatus 10 is shown as being mounted in the intake manifold 16 of the engine 12 for injecting fuel through the intake manifold 16 into one combustion chamber of the engine 12. Alternate configurations or mounting positions of the fuel injection/spark ignition apparatus 10 may also be employed, such as mounting the fuel injection/spark ignition apparatus 10 directly in each combustion chamber of the engine 12.

Figure 2:
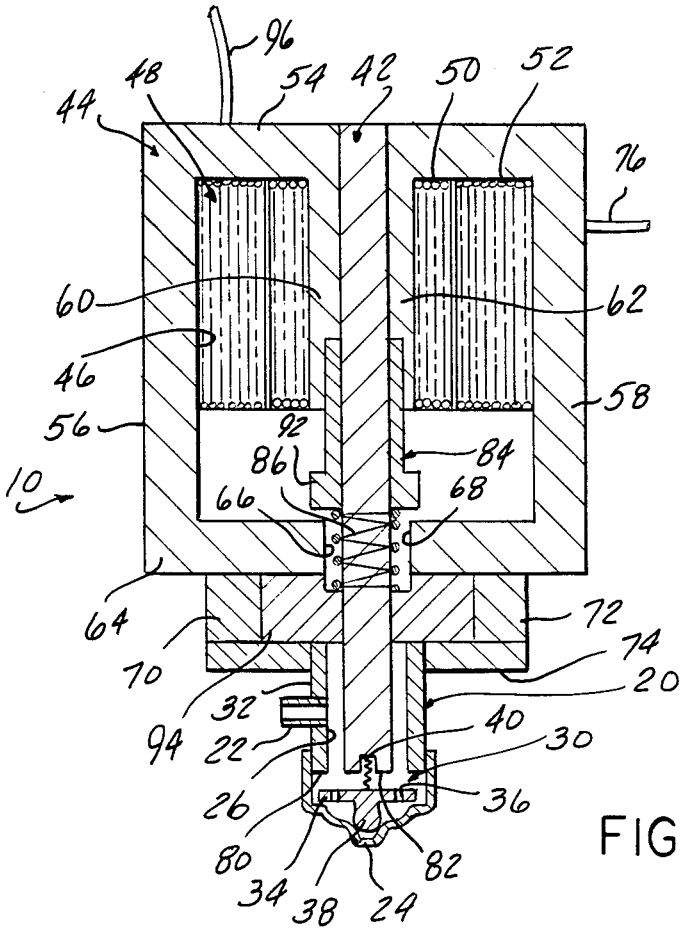
FIG. 2 is a cross sectional view of the combined fuel injection/spark ignition apparatus of the present invention, with the elements thereof shown in their de-energized positions.

The combined fuel injection/spark ignition apparatus 10, as shown in detail in FIG. 2, includes a valve body 20 having a fuel inlet 22, a fuel outlet 24 and a fuel flow path 26 extending therebetween for the selective flow of fuel between the fuel inlet 22 and the fuel outlet 24. The valve body 20 may be mounted in a suitable, sealed housing, not shown, to protect the components from the severe engine operating environment.

Fuel flow control means denoted in general by reference number 30 is mounted in the valve body 20 and functions to selectively open and close the fuel flow path 26 for the flow of fuel between the fuel inlet 22 and the fuel outlet 24.

The valve body 20 generally comprises a cylindrical member having a side wall 32 with an aperture therein forming the fuel inlet 22. The side wall 32 is preferably formed of a magnetic, ferrous material for reasons which will be described in greater detail hereafter. The fuel flow control means or first plunger 30 has a circular cross section with a generally planar portion 34 having a plurality of apertures 36 extending therethrough for fuel flow through the first plunger 30. A centrally located needle valve 38 is formed on the first plunger 30 for engagement with the orifice or fuel outlet 24 formed in the valve body 20. The first plunger 30 is movable from a first position shown in FIG. 2 to a second position shown in FIG. 3 by means which will be described hereafter.

A first biasing means 40 in the form of a spring is mounted within the valve body 20 for biasing the first plunger 30 to the first position in which the needle valve 38 is disposed in engagement with the fuel outlet 24 thereby closing the fuel flow path 26 to the flow of fuel from the fuel inlet 22 through the fuel outlet 24.

The combined fuel injection/spark ignition apparatus 10 also includes an inner core 42 and a spaced outer core 44. The inner core 42 has an elongated shape and is preferably formed of a plurality of laminations of magnetic material. As shown in FIG. 2, the inner core 42 has a generally square cross section; although other configurations may also be employed.

The outer core 44 is likewise formed of a plurality of laminations of a magnetic material and is formed to contact the inner core 42 at one portion as well as having a portion spaced from the inner core 42 defining an aperture 46 for receiving a coil means denoted in general by reference number 48. The coil means 48 is formed of primary and secondary windings 50 and 52, respectively, which are wound around the portion of the outer core 44 in contact with the inner core 42 adjacent one end of the inner core 42 and outer core 44 as shown in FIG. 2.

The outer core 44 is formed with an upper leg 54 through which the inner core 42 extends, opposed outer legs 56 and 58, and inner legs 60 and 62 which are disposed in registry with the inner core 42 along a substantial portion of their length.

The outer core 44 also includes an intermediate leg portion formed of leg 64 which is broken in the center and has opposed faces 66 and 68 spaced from an intermediate portion of the inner core 42. The outer core 44 also includes a bottom core portion having depending legs 70 and 72 and a crosswise extending portion 74 which connects with the depending side walls 32 of the valve body 20. It should be noted that the depending side walls 32 of the valve body 20 also form a part of the magnetic flux path with the outer core 44.

The combined fuel injection/spark ignition apparatus 10 of the present invention also includes control means, described in greater detail hereafter and shown in FIG. 5, which supplies current on leads 76 to the primary winding 50 of the coil means 48 at first and second levels or magnitudes.

Figure 3:
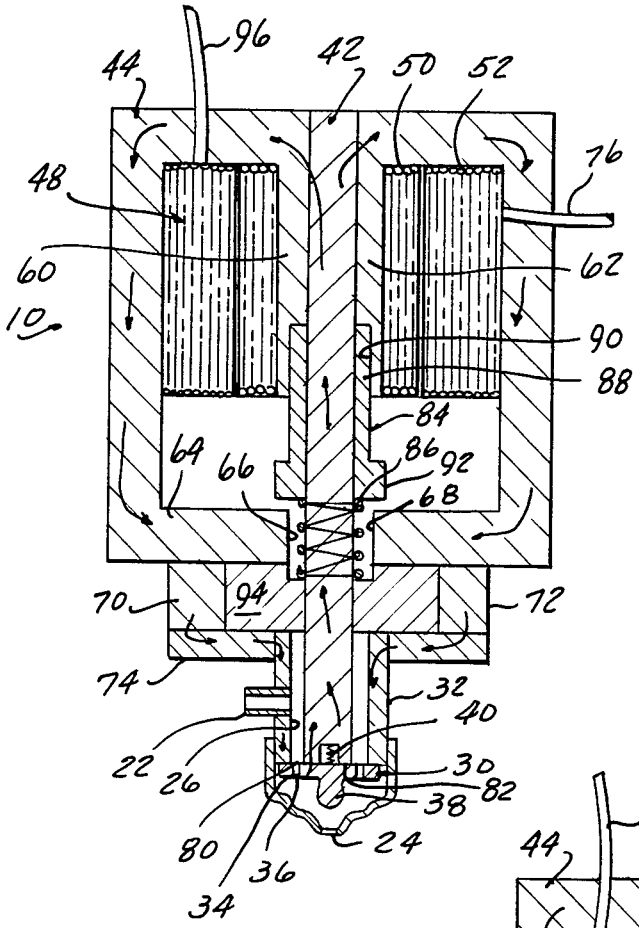
FIG. 3 is a cross sectional view similar to FIG. 2; but showing the position of the elements of the apparatus when a current of a first magnitude is applied to the primary winding of the coil.

The combined fuel injection/spark ignition apparatus 10 of the present invention includes first means through which magnetic flux passes when a current of a first magnitude is applied to the primary winding 50 of the coil 48 for moving the first plunger 30 from the first position shown in FIG. 2 to a second position shown in FIG. 3 opening the fuel flow path 26 to the flow of fuel from the fuel inlet 22 through the fuel outlet 24. A second means is also provided through which magnetic flux passes when current at a second higher level is applied to the primary winding 50 of the coil means 48 for shunting flux from the first means thereby moving the first plunger 30 to the first position closing the fuel flow path 26 under the influence of the first biasing means 40.

In a preferred embodiment, the first means comprises the end portions 80 of the depending side walls 32 of the valve body 20 being disposed in line with the end portion 82 of the inner core 42 and normally spaced from the first plunger 30 so as to be bridged and thereby connected to the inner core 42 for the flow of magnetic flux therethrough when the first plunger 30 is moved to the second position shown in FIG. 3.

In operation, the application of electric current at a first level or magnitude through the lead 76 to the primary winding 50 of the coil 48 induces a magnetic field in the inner core 42 and the outer core 44 which flows in the direction of the arrows shown in FIG. 3 from the inner core 42 through the outer core 44. As shown in FIG. 3, the first means which includes the first plunger 30 bridging the end portions 80 and 82 of the outer core 44 and the inner core 42, respectively, enables magnetic flux to pass through the outer core 44 and its lower portions 70, 72, 74 and the depending side walls 32 of the valve body 20 through the first plunger 30 and back into the inner core 42 thereby forming a complete magnetic flux circuit through the inner and outer cores 42 and 44. The magnetic field generated by the application of current to the primary winding 50 attracts the first plunger 30 to the spaced ends 80 and 82 of the outer core 44 and the inner core 42 and is designed to have a force sufficient to overcome the biasing force of the first biasing means 40. This draws the first plunger 30 into contact with the ends 80 and 82 of the outer core 44 and inner core 42 and retains the first plunger 30 in the position shown in FIG. 3 as long as current equal to or greater than the first magnitude is applied to the primary winding 50.

As noted above, the apertures 36 in the first plunger 30 provide fluid flow passages through the first plunger 30 opening the fuel flow path 26 to the flow of fuel between the fuel inlet 22 and the fuel outlet 24 since the needle valve 38 is spaced from the fuel outlet 24.

Figure 4:
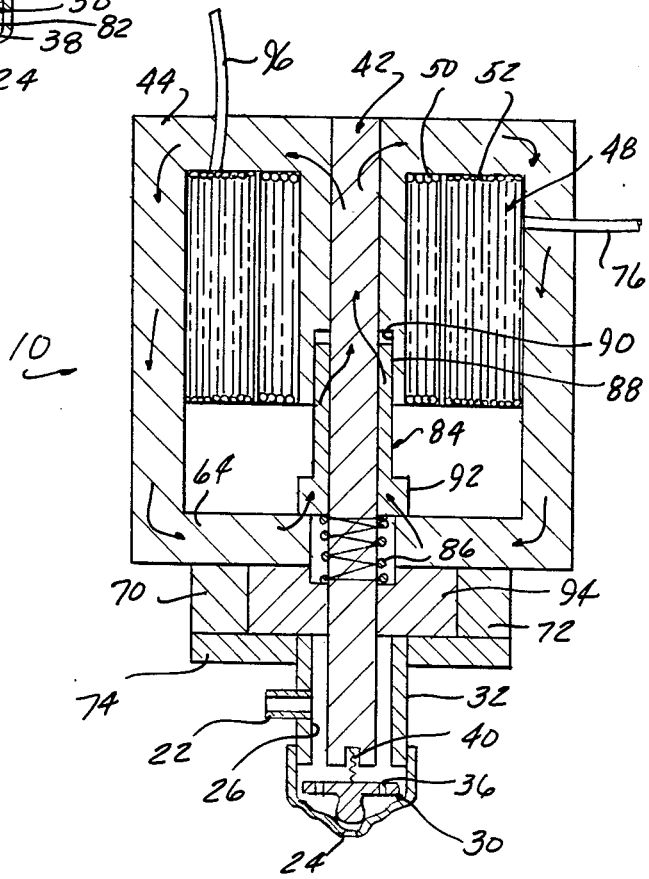
FIG. 4 is a cross sectional view generally similar to FIG. 2; but showing the position of the elements of the apparatus when a current of a second higher magnitude is applied to the primary winding of the coil.

The second means includes the intermediate leg 64 of the outer core 44, the intermediate portion of the inner core 42, a second movable plunger 84 and a second biasing means 86, such as a coil spring. The second plunger 84 is slidably mounted about the intermediate portion of the inner core 42 and includes an aperture corresponding in shape to the shape of the inner core 42. The upper end portion 88 of the second plunger 84 slides within a recess 90 formed in the inner leg portions 60 and 62 of the outer core 44. The lower end portion 92 of the second plunger 84 has an enlarged cross section which forms an outwardly extending flange which is sized to space and bridge the opposed end faces 66 and 68 of the leg 64 of the outer core 44 so as to bring into magnetic flux contact the outer core 44 and inner core 42 at the intermediate portions of the outer core 44 and inner core 42 as shown in FIG. 4. As shown in FIG. 4, the second biasing means 86 seats at one end in a valve seat 94 formed of a nonmagnetic material which is mounted between the intermediate leg 64 of the outer core 44 and the bottom leg 74.

The second biasing means 86 is formed with a higher biasing constant than the biasing force of the first biasing means 40 so as to resist the magnetic attraction in the outer core 44 when a current at a first magnitude is applied to the primary winding 50. The current of a second magnitude, when applied to the primary winding 50 of the coil 48, generates a higher magnetic flux in the outer core 44 sufficient to overcome the biasing force of the second biasing means 86 and attract the enlarged end portion 92 of the second plunger 84 toward the intermediate leg portion 64 of the outer core 44 until the enlarged end portion 92 of the second plunger 84 contacts the leg 64 of the outer core 44. This arrangement, as shown in FIG. 4, forms a shunt path denoted by the arrows in FIG. 4 for magnetic flux which bypasses and terminates the flow of magnetic flux in the lower portion of the outer core 44 through the first plunger 30. The lack of magnetic force acting on the first plunger 30 enables the first plunger 30 to be moved under the influence of the first biasing means 40 away from the end portions 80 and 82 of the outer core 44 and inner core 42, respectively, to its first position closing the fuel outlet 24 and ceasing the flow of fuel through the fuel flow path 26 in the valve body 20.

Likewise, cessation of the application of the second current level to the primary winding 50 will collapse the magnetic field in the outer core 44 and inner core 42 thereby enabling the second plunger 84 to be moved under the influence of the second biasing means 86 to its first position shown in FIG. 3 in which the enlarged end portion 92 is spaced from the intermediate leg 64 of the outer core 44.

Also, collapse of the magnetic field due to the cessation of current flow through the primary winding 50 generates a high voltage in the secondary winding 52 which is applied through leads 96 to the spark plug 14 thereby igniting the spark plug 14 and causing combustion of the fuel which has been injected into a particular combustion chamber of the engine 12.

Referring now to FIGS. 5, 6A, 6B and 6C, a description of the construction and operation of the control means for applying the first and second current levels to the primary winding 50 will be presented. As shown in FIG. 5, the control means for applying current to the primary winding 50 includes a central processing unit 100. The central processing unit 100 may be any conventional microprocessor which executes a stored control program. The central processing unit 100 receives inputs from the engine 12 indicating the engine crank shaft angle, engine operating speed, engine temperature, air temperature, fuel temperature, air/fuel mixture ratio, among others. Such inputs are conventional in electronic controlled fuel injection systems and their use and operation of the output of the central processing unit 100 will not be presented here as they do not form part of the invention and, most importantly, are well known to one skilled in the art of constructing fuel injection systems.

The outputs of the central processing unit 100 are applied to a plurality of decoder/driver circuits 102, one for each cylinder of the engine 12. The decoder/driver circuits 102 are conventional and decode the output of the central processing unit 100 specifying which cylinder of the engine is operative. The decoder/driver circuit 102 provides two outputs labeled A and B. The outputs A and B from the decoder/driver circuit 102 are connected to a resistive network formed of parallel connected resistors $R_1$ and $R_2$. The resistor $R_2$ is selectively connected into the resistive network in parallel with resistor $R_1$ via a switch means denoted in general by reference number 104. The switch means 104 is controlled by the output B from the decoder/driver circuit 102. For example, the switch means 104 may be a gate driven SCR having an input terminal or lead connected to the A output of the decoder/driver circuit 102 and an output lead connected to the resistor $R_2$.

The output of the resistive network is connected to an output means or driver 106 which is connected between the plus and minus leads of an electric power source along with the primary winding 50 of the coil means 48.

In a preferred embodiment, the output means 106 is a power transistor $T_1$ having its base connected through a biasing network formed of resistors $R_3$ and $R_4$ to the output of the resistive network formed of the selectively parallel connected resistors $R_1$ and $R_2$. The collector and emitter leads of the transistor $T_1$ are connected between a + voltage input through a diode $D_1$ to the primary winding 50.

Conduction of the transistor $T_1$ due to varying base current levels results in varying current levels flowing through the primary winding 50 which generates varying voltages for inducing current flow in the secondary winding 52 as is conventional in magnetically coupled windings.

The different current levels applied to the primary winding 50 are shown in FIG. 6A in which a current of a first level or magnitude 108 is applied to the primary winding 50 during the intake cycle of the engine. A current of a second higher level 110 is applied to the primary winding 50 toward the end of the intake portion of the engine cycle and throughout the compression cycle of the engine. At the end of the compression cycle, the fuel is to be ignited and the current is discontinued to the primary winding 50.

In order to apply current of two distinct levels to the primary winding 50, the central processing unit 100 will generate appropriate output signals to the decoder/driver circuit 102 associated with a particular cylinder of the engine and drive the output A of the decoder/driver 102 high at the beginning of the intake stroke of the engine as shown in FIG. 6B. Since the switch 104 is open at this time, all of the current from the decoder/driver output A flows through the resistor $R_1$ to the base of transistor $T_1$ thereby limiting current flow through the transistor $T_1$ and the primary winding 50 to a first low level causing the operation of the fuel injection/spark ignition apparatus 10 as shown in FIG. 3. When the second higher current level is desired during the engine operating cycle, such as at the end of the intake portion of the engine cycle as shown in FIG. 6C, the central processing unit 100 generates a signal to the decoder/driver circuit 102 causing output B to go high. This activates the switch 104 connecting the resistor $R_2$ in parallel with the resistor $R_1$. This reduces the overall resistance presented by the resistive network and increases the base current in the transistor $T_1$. This is amplified by the transistor $T_1$ and causes a higher current to flow through the transistor $T_1$ and the primary winding 50 causing the movement of the components of the fuel injection/spark ignition apparatus 10 to the position shown in FIG. 4.

When it is desired to ignite the fuel through ignition of the spark plug 14, the central processing unit 100 issues appropriate commands to the associated decoder/driver circuit 102 causing the driver outputs A and B to go low as shown in FIG. 6B and 6C cutting off the base current to the transistor $T_1$ and the current to the primary winding 50. This collapses the magnetic field in the inner and outer cores 42 and 44 causing a high voltage pulse to be generated in the secondary winding 52 of the coil 48 which is applied to the spark plug 14 to ignite the fuel in the associated combustion chamber of the engine 12.

Without current applied to the primary winding 50, the first and second plungers 30 and 84 return to their first positions as shown in FIG. 2 for the next operating cycle of the combined fuel injection/spark ignition apparatus 10.

In summary, there has been disclosed a unique combined fuel injection/spark ignition apparatus which utilizes a single electromagnetic coil to control the operation of a fuel injector valve as well as to apply a high voltage to the spark igniting device of an internal combustion engine when current at two different levels is applied to the primary winding of the fuel injection/-spark ignition apparatus. This arrangement eliminates the need for separate energization coils for each spark plug and each fuel injector valve as previously employed in fuel injection/spark ignited engine systems. This arrangement simplifies the fuel injection/spark ignition system of an engine.

What is claimed is:

1. A combined fuel injection/spark ignition apparatus comprising:

a valve body having a fuel inlet, a fuel outlet and a fuel flow path extending between the fuel inlet and the fuel outlet;

fuel flow control means for controlling the flow of fuel between the fuel inlet and the fuel outlet;

an inner core;

an outer core surrounding the inner core;

coil means including primary and secondary windings surrounding the inner core for inducing magnetic flux in the inner and outer cores, the secondary winding being connectible to a spark igniting means of the engine;

means for applying electric current at first and second levels to the primary winding of the coil means at predetermined time intervals;

first means, including the inner core, outer core and the valve body, through which magnetic flux passes when a current of a first level is applied to the primary winding of the coil means for moving the fuel flow control means to a second position opening the fuel flow path for the flow of fuel between the fuel inlet and the fuel outlet; and second means, including the inner core and the outer core, through which magnetic flux passes when current of a second higher level is applied to the primary winding for shunting magnetic flux from the first means and causing the fuel flow control means to move to a first position closing the fuel flow path.

2. The combined fuel injection/spark ignition apparatus of claim 1 wherein the fuel flow control means comprises:

a first plunger movable between a first position closing the fuel flow path between the fuel inlet and the fuel outlet and a second position opening the fuel flow path to the flow of fuel from the fuel inlet through the fuel outlet; and first biasing means for normally biasing the first plunger to the first position.

3. The combined fuel injection/spark ignition apparatus of claim 2 wherein the first means comprises:

the inner and outer cores having spaced end portions, the fuel flow control means being spaced from the end portions of the inner and outer cores when in the first position and being magnetically attracted to and connecting the ends portions of the inner and outer cores when moved to the second position when current of a first level is applied to the primary winding of the coil means.

4. The combined fuel injection/spark ignition apparatus of claim 3 wherein the second means comprises:.

an intermediate portion formed on the outer core having opposed faces spaced from an intermediate portion of the inner core;

a second plunger movably disposed about the inner core and movable between a first position spaced from the intermediate portion of the outer core and a second position contacting the intermediate portion of the outer core and connecting the intermediate portion of the outer core to the inner core; and second biasing means for normally biasing the second plunger to the first position.

5. The combined fuel injection/spark ignition apparatus of claim 4 wherein the second biasing means has a higher biasing force than the first biasing means.

6. The combined fuel injection/spark ignition apparatus of claim 4 wherein the first and second biasing means each comprise a spring.

7. The combined fuel injection/spark ignition apparatus of claim 1 wherein the current applying means comprises:

central processing means, responsive to engine operation condition inputs and executing a stored control program, for generating signals causing first and second current levels to be applied to the primary winding of the coil means; and output means, responsive to the central processing means, for generating first and second current levels in the primary winding.

8. The combined fuel injection/spark ignition apparatus of claim 7 wherein:

the output means comprises a power transistor; and further including:

means, responsive to the output of the central processing means, for varying the base current to the power transistor to generate two distinct output current levels through the power transistor.

9. The combined fuel injection/spark ignition apparatus of claim 8 wherein the base current varying means comprises;

first resistance means;

second resistance means;

switch means, responsive to the central processing unit, for selectively connecting the second resistance means in parallel with the first resistance means to selectively vary the base current to the transistor.

10. A combined fuel injection/spark ignition apparatus comprising:

a valve body having a fuel inlet, a fuel outlet and a fuel flow path extending between the fuel inlet and the fuel outlet;

a first plunger housed in the valve body and movable between a first position closing the fuel flow path between the fuel inlet and the fuel outlet and a second position opening the fuel flow path to the flow of fuel from the fuel inlet through the fuel outlet;

first biasing means for normally biasing the first plunger to the first position;

an inner core;

an outer core surrounding the inner core;

coil means including primary and secondary windings surrounding the inner core for inducing magnetic flux in the inner and outer cores, the secondary winding being connectible to a spark igniting means of the engine;

central processing means, responsive to engine operation condition inputs and executing a stored control program for generating signals causing first and second current levels to be applied to the primary winding of the coil means;

output means, responsive to the central processing means, for applying first and second current levels to the primary winding;

first means, including the inner core, outer core and the valve body, through which magnetic flux passes when a current of a first level is applied to the primary winding of the coil means for moving the first plunger to a second position opening the fuel flow path for the flow of fuel between the fuel inlet and the fuel outlet, the first means including the inner and outer cores having spaced end portions, the first plunger being spaced from the end portions of the inner and outer cores when in the first position and being magnetically attracted to and connecting the ends portions of the inner and outer cores when moved to the second position when current of a first level is applied to the primary winding of the coil means; and second means, including the inner core and the outer core, through which magnetic flux passes when current of a second higher level is applied to the primary winding for shunting magnetic flux from the first means and causing the first plunger to move to the first position closing the fuel flow path, the second means including:

an intermediate portion formed on the outer core having opposed faces spaced from an intermediate portion of the inner core;

a second plunger movably disposed about the inner core and movable between a first position spaced from the intermediate portion of the outer core and a second position contacting the intermediate portion of the outer core and connecting the intermediate portion of the outer core to the inner core; and second biasing means for normally biasing the second plunger to the first position, the second biasing means having a higher biasing force than the first biasing means.

* * * * *